US009079065B2

(12) United States Patent
Perkins et al.

(10) Patent No.: US 9,079,065 B2
(45) Date of Patent: Jul. 14, 2015

(54) CAMMING DEVICE

(75) Inventors: Brenden Perkins, Salt Lake City, UT (US); Samuel Goodrich Lacey, Park City, UT (US); Bill Belcourt, Salt Lake City, UT (US); Jacob Hall, Draper, UT (US); Jeremy Andrew Steck, Salt Lake City, UT (US); Joseph Benjamin Walker, Draper, UT (US); Kent Lansing Dodge, Salt Lake City, UT (US)

(73) Assignee: Black Diamond Equipment Ltd., Salt Lake City, UT (US)

( * ) Notice: Subject to any disclaimer, the term of this patent is extended or adjusted under 35 U.S.C. 154(b) by 512 days.

(21) Appl. No.: 13/524,101

(22) Filed: Jun. 15, 2012

(65) Prior Publication Data

US 2013/0333513 A1 Dec. 19, 2013

(51) Int. Cl.
*A47F 5/08* (2006.01)
*A63B 29/02* (2006.01)

(52) U.S. Cl.
CPC ..... *A63B 29/024* (2013.01)

(58) Field of Classification Search
CPC ..... A63B 29/024; Y10S 248/925
USPC ..... 248/231.9, 925, 231.91; 294/95, 97
See application file for complete search history.

(56) References Cited

U.S. PATENT DOCUMENTS

| | | | | |
|---|---|---|---|---|
| 4,184,657 | A * | 1/1980 | Jardine | 248/231.9 |
| 4,832,289 | A | 5/1989 | Waggoner | |
| 4,923,160 | A | 5/1990 | Waggoner | |
| 4,949,927 | A | 8/1990 | Madocks et al. | |
| 5,860,629 | A * | 1/1999 | Reed | 248/231.9 |
| 6,042,069 | A | 3/2000 | Christianson | |
| 6,250,175 | B1 | 6/2001 | Noetzold | |
| 6,375,139 | B1 * | 4/2002 | Murray et al. | 248/231.9 |
| 6,606,921 | B2 | 8/2003 | Noetzold | |
| 7,055,656 | B2 | 6/2006 | Drew | |
| 2005/0098696 | A1 | 5/2005 | Lowe | |

FOREIGN PATENT DOCUMENTS

| | | |
|---|---|---|
| EP | 1557202 | 7/2005 |
| GB | 2347360 | 6/2000 |
| GB | 2369068 | 5/2002 |

* cited by examiner

*Primary Examiner* — Gwendolyn Baxter
(74) *Attorney, Agent, or Firm* — Baker & Associates PLLC; Trent Baker

(57) ABSTRACT

A smaller-active camming device including a head member, a plurality of cam lobes, a retraction system, and a connection system. The head member includes a terminal and an axle. The axle comprises a unique configuration of multiple radial regions extending from opposite sides of the terminal. The radial regions of the axle are offset with respect to one another along at least one three dimensional axis. The offset of the radial regions is configured to reduce the geometrical interference of the cam lobes across the camming range.

20 Claims, 7 Drawing Sheets

CAMMING DEVICE

FIELD OF THE INVENTION

The invention generally relates to active camming devices. In particular, the present invention relates to improved smaller cam head configurations.

BACKGROUND OF THE INVENTION

Climbers generally use clean protection devices for two distinct purposes. First, a clean protection device may be used as a form of safety protection for protecting a climber in the event of a fall, and second, a clean protection device may intentionally be used to artificially support a climber's weight. Clean protection devices cam or wedge into a crack, hole, gap, orifice, taper, or recess in order to support an outward force. The surface on which the clean protection device supports the outward force is considered the protection surface. The protection surface can consist of natural materials such as rock or may consist of artificial materials such as concrete or wood.

Clean protection devices are generally divided into the categories of active and passive. Passive protection devices include a single object which contacts the protection surface to support an outward force. For example, a wedge is a passive protection device because it has a single head with a fixed shape. There are numerous types of passive protection devices including nuts, hexes, tri-cams, wedges, rocks, and chocks. Active protection devices include at least two movable objects that can move relative to one another to create a variety of shapes. For example, a slidable chock or slider nut is considered an active protection device because it includes two wedges that move relative to one another to wedge into various shaped crevices. When the two wedges of the slider nut are positioned adjacent to one another, the overall width of the protection device is significantly larger than if the two wedges are positioned on top of one another. The two wedges must make contact with the protection surface in order to actively wedge the device within the protection surface. A further subset of active protection is camming devices. These devices translate rotational displacement into linear displacement. Therefore, a slider chock would not be an active camming device because the two wedges simply slide relative to one another and do not rotate. Camming devices may include two, three, and four cam lobes. The cam lobes on an active camming device are generally spring biased into an expanded position and are able to rotate or pivot about an axle to retract. In operation, at least one cam lobe on either side of the unit must make contact with the protection surface for the device to be able to actively support an outward force. Some active protection devices can also be used passively to support outward forces as well.

Active protection devices are generally preferable to passive protection devices because of their ability to cam into a variety of rock or surface features. For example, a standard four-cam unit has a particular camming range that allows it to cam into features within a particular size range. Whereas, a passive protection device is limited to a single shape and can therefore only cam or wedge into features that conform to that particular shape. Unfortunately, the largest disadvantage of active protection devices is their considerable weight in relation to passive protection devices. One of the heavier components of an active protection device is the connection system. The connection system connects the camming objects to some form of clip-in point. The two most common connection systems used in three and four cam units are single stem and double stem systems. Double stem systems include a U-shaped cable that attaches independently to two cable terminals on either end of the head of the protection device. The clip-in point of a double stem system is simply the bottom of the U-shaped cable. Single stem systems include a single cable that is attached to a single cable terminal located at the center of the head of the protection device. The single stem system generally includes some form of clip-in loop attached to the single cable. Alternatively, a clip-in loop can be created by coupling the single cable back to itself with some form of swage. Single stem connection systems are generally preferable for larger cams because they are less likely to obstruct particular camming placements.

One of the problems with smaller active camming devices is the limited cam range. Conventional small active camming devices have a proportionally smaller camming range because of the smaller space within which the cam lobes are able to rotate. To overcome this limitation, conventional smaller active camming devices have incorporated various technologies such as the utilization of less than four cam lobes. In addition, conventional smaller active camming devices have increased the camming range by increasing the camming angle. Unfortunately, these solutions generally compromise the performance and reliability of the active camming device. Likewise, active camming devices with multiple cam lobe axles have also been used to increase camming range. Unfortunately, multiple axles cannot be effectively utilized in smaller active camming devices because of the ratio of the minimum axle diameter with respect to the respective smaller cam lobes.

Therefore, there is a need in the industry for an improved active smaller camming system that efficiently increases camming range while maintaining performance.

SUMMARY OF THE INVENTION

One embodiment of the present invention relates to an improved smaller active camming device including a head member, a plurality of cam lobes, a retraction system, and a connection system. The head member includes a terminal and an axle. The axle comprises a unique configuration of multiple radial regions extending from opposite sides of the terminal. The radial regions of the axle are offset with respect to one another along at least one three dimensional axis. The offset of the radial regions is configured to reduce the geometrical interference of the cam lobes across the camming range. A second embodiment of the present invention relates to an active camming device head member including a terminal and an axle.

Embodiments of the present invention represent a significant advance in the field of smaller active camming devices and respective head members. As discussed above, conventional smaller active camming devices have a small camming range. Likewise, alternative existing active camming devices have an increased camming range at the expense of performance, reliability, durability, and/or manufacturing efficiency. The improved active camming device and respective head member concepts of the present invention overcome these limitations through the use of a unique axle. Rather than a conventional uniform cylindrically shaped axle, embodiments of the present invention include an axle with multiple offset radial regions which may have different geometrical characteristics. The radial regions of the axle are offset to enable corresponding small cam lobes to articulate or rotate about the axle without interference or obstruction. Therefore, the camming range of the active camming device is increased.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

One embodiment of the present invention relates to an improved smaller-active camming device including a head member, a plurality of cam lobes, a retraction system, and a connection system. The head member includes a terminal and an axle. The axle comprises a unique configuration of multiple radial regions extending from opposite sides of the terminal. The radial regions of the axle are offset with respect to one another along at least one three dimensional axis. The offset of the radial regions is configured to reduce the geometrical interference of the cam lobes across the camming range. A second embodiment of the present invention relates to an active camming device head member including a terminal and an axle. Also, while embodiments are described in reference to a smaller active camming device, it will be appreciated that the teachings of the present invention are applicable to other areas including but not limited to larger active camming devices and partially active camming devices.

The following terms are defined as follows:

Smaller active camming device—an active camming device configured to cam within a region smaller than one inch.

Axle—a structure around which the cam lobes of an active camming device rotate.

Radial region—a region disposed in a radial location with respect to another member.

Offset—a misalignment of members along at least one three dimensional axis. Therefore, two members may be offset in the Y axis and substantially aligned in the X and Z axis.

Reference is initially made to FIGS. 1-4, which illustrates a cam head of a small active camming device, designated generally at 100. The cam head 100 is substantially T shaped. The cam head 100 includes a set of axles 125, a lower terminal region 120 and an upper terminal region 110. The axles 125, lower terminal region 120, and upper terminal region 110 may be composed as a single member or separately composed and fixably coupled. The lower terminal region 120 is substantially cylindrical shaped to enable coupling with the stem of an active camming device. For example, the lower terminal region 120 may include a recess within which one or more cable ends may be swage or braze coupled. The upper terminal region 110 is coupled to both the lower terminal region 120 and the axles 125. The upper terminal region 110 is configured to support the axles 125 orthogonal to the lower terminal region 120, as shown. The axles 125 are oriented orthogonal to the lower terminal region 120 and the lengthwise orientation of the remaining portions of an active camming device (see FIGS. 6-8).

Figure 2:
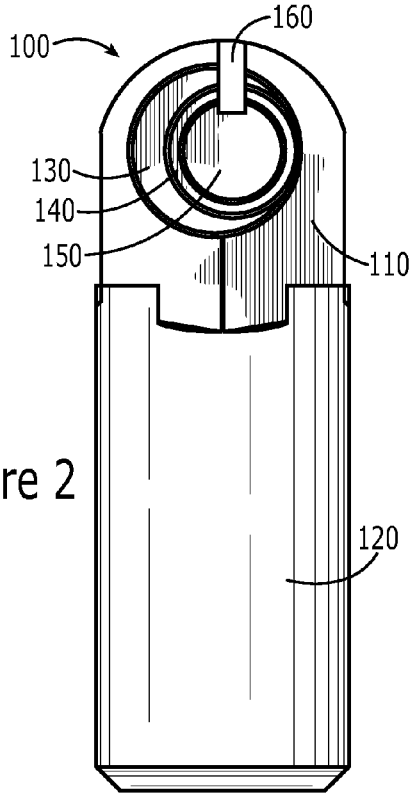
FIG. 2 illustrates a side view of the cam head of FIG. 1.
Figure 3:
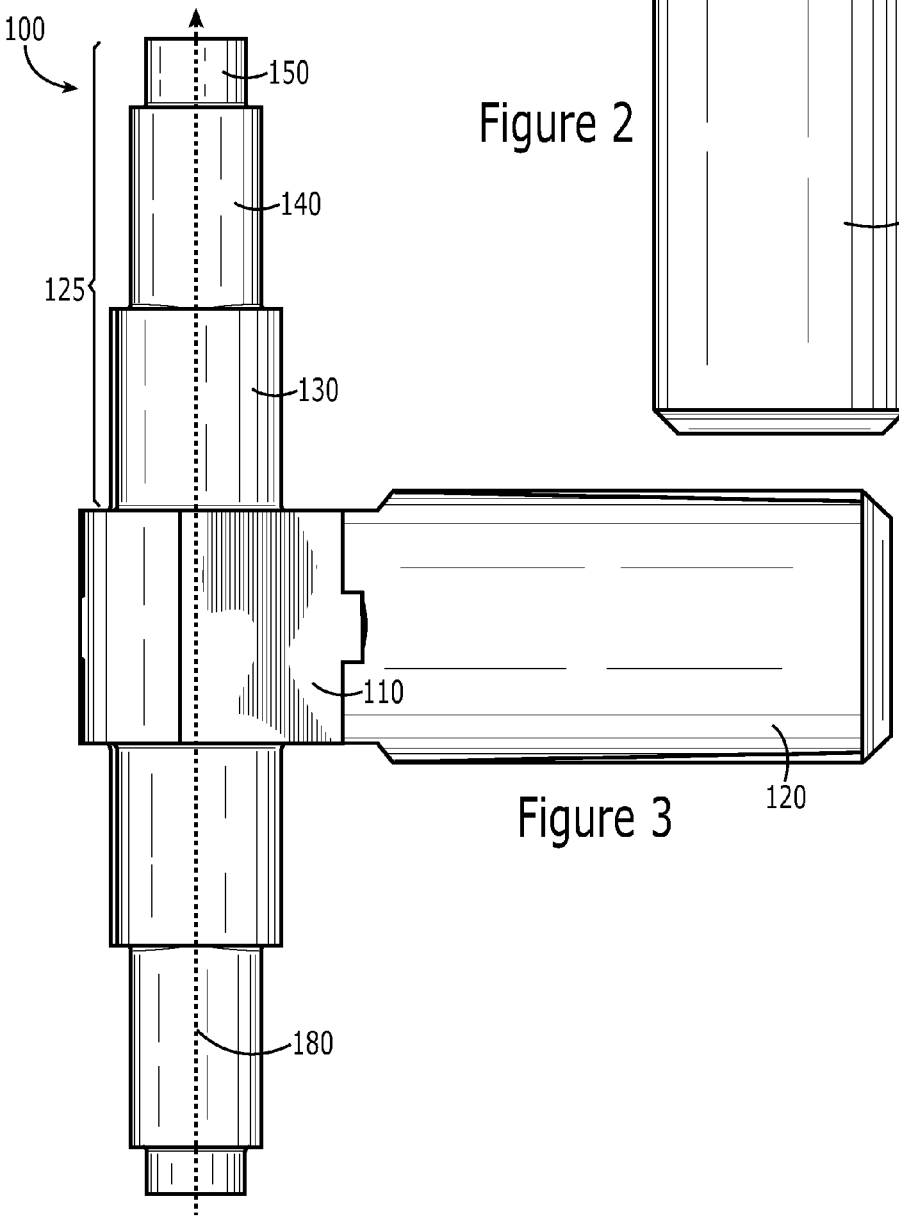
FIG. 3 illustrates a second side view of the cam head of FIG. 1.
Figure 4:
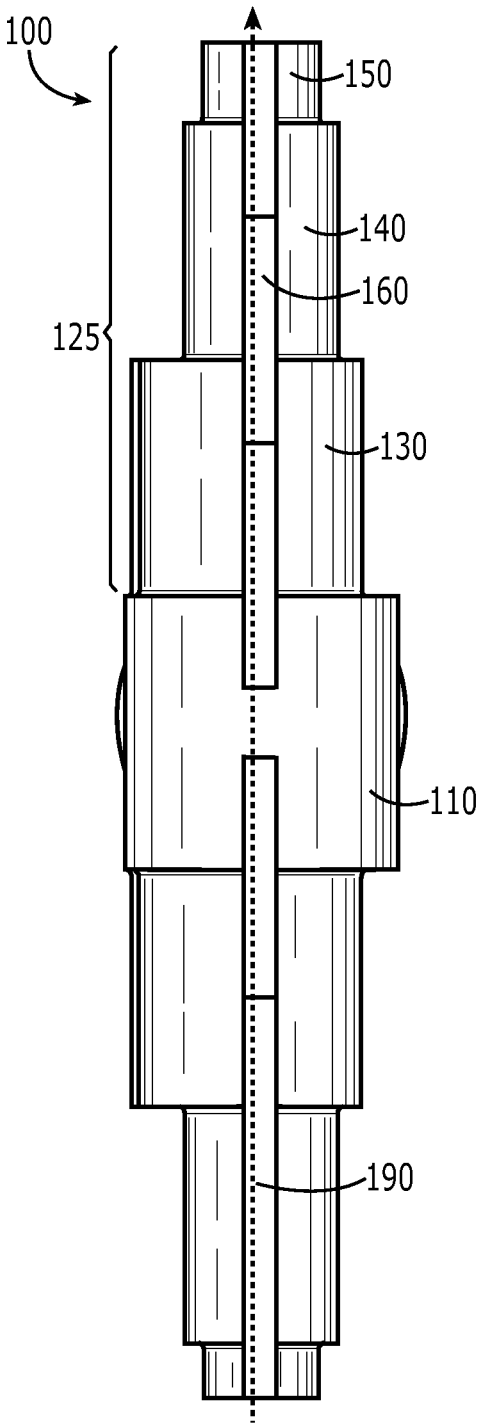
FIG. 4 illustrates a top view of the cam head of FIG. 1.

The axles 125 are uniquely configured to include a plurality of radial regions 130, 140, 150 extending from the upper terminal 110. The radial regions 130, 140, 150 form each axle 125 and extend from the upper terminal 110 opposite and parallel to the second axle. The radial regions 130, 140, 150 are substantially cylindrical regions as shown to enable corresponding cam lobes to rotatably couple on the external surface. The radial regions 130, 140, 150 are lengthwise oriented orthogonal to the upper terminal 110 such that the curved external surface of each of the radial regions 130, 140, 150 are oriented parallel to one another. The diameters of the radial regions 130, 140, 150 are sized in a descending manner with respect to the upper terminal 110. Therefore, the first radial region 130 disposed proximal to the upper terminal region 110 includes a diameter that is the larger than the diameters of the second and third radial regions 140, 150. The descending diameter configuration of the illustrated embodiment is optional for purposes of manufacturing tolerances. The cylindrical length of the first and second radial regions 130, 140 is configured to correspond with the width of a cam lobe (not shown). The cylindrical length of the third radial region 150 corresponds to the width of the cap member portion of a connection system (see FIG. 6). It will be appreciated that an alternative connection system may be utilized between the cam lobes and the radial regions 130, 140, 150, in accordance with alternative embodiments, and therefore the third radial region is optional. The radial regions 130, 140, 150 are offset along a first three dimensional axis 190 as shown in FIGS. 2 and 4. The radial regions 130, 140, 150 are also substantially aligned along a second three dimensional axis 180 as shown in FIG. 3. The specific offset parameters are configured to geometrically reduce the rotational interference or minimum area of the corresponding cam lobes in the retracted state (see FIG. 8), thereby increasing the cam range of an active camming device system.

The illustrated radial regions 130, 140, 150 and upper terminal region 110 each include a channel 160 along the distal most external surface with respect to the total cam head 100 or active camming device. The channel portion of each radial region 130, 140, 150 and upper terminal portion 110 is aligned such that the channel 160 extends along the entire axis 125 and into the upper terminal region 110. The channel 160 may be used for coupling the individual cam lobes (not shown) to each of the radial regions 130, 140, 150 (see FIGS. 6-8). It will be appreciated that alternative coupling systems may be utilized between the cam lobes and the radial regions and therefore the channel 160 is optional.

Figure 5:
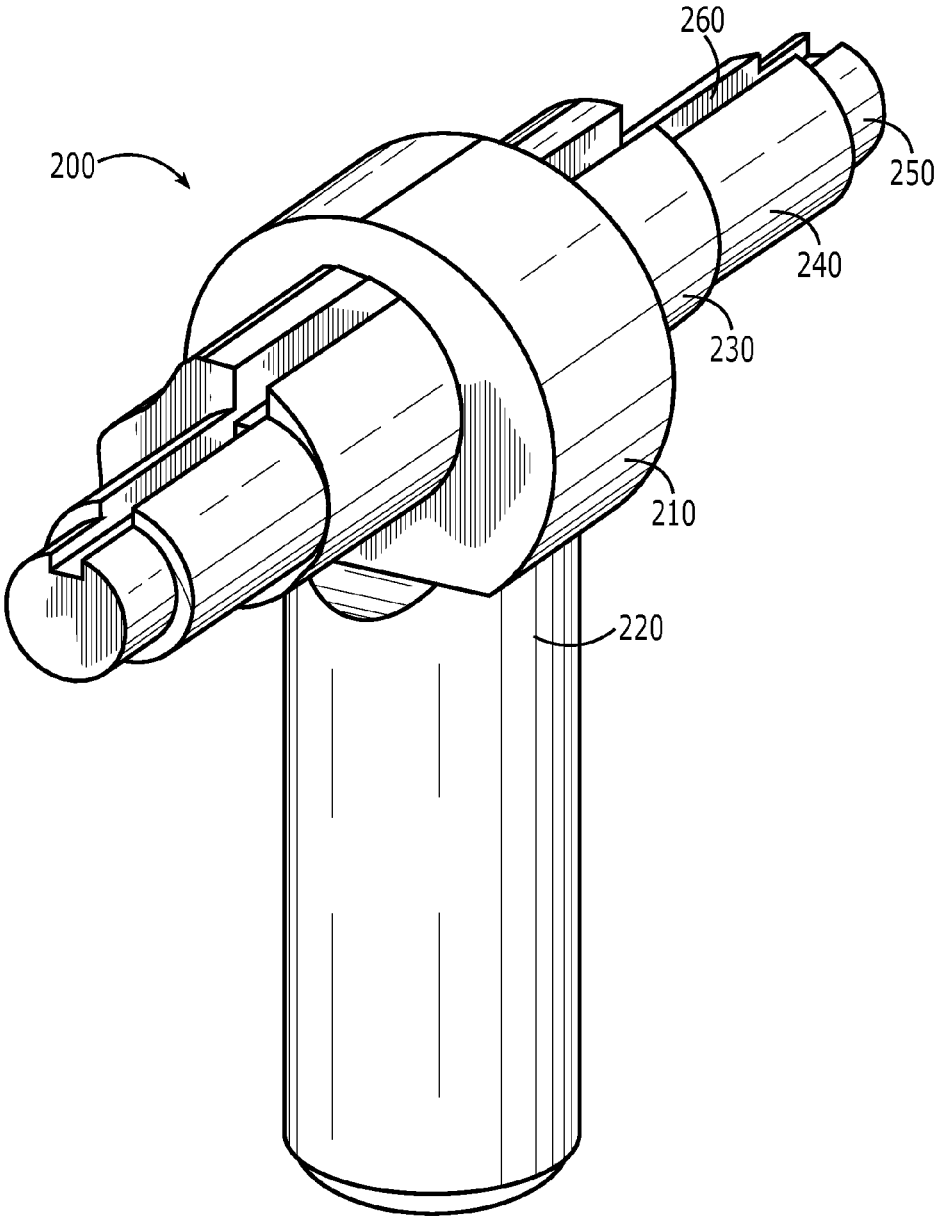
FIG. 5 illustrates an alternative cam head in accordance with embodiments of the present invention.

Reference is next made to FIG. 5, which illustrates an alternative cam head, designated generally at 200. The alternative cam head 200 includes an upper and lower terminal region 210, 220, a set of radial regions 230, 240, 250, and a channel 260. The alternative cam head illustrates alternative shapes regions and/or separately manufactures components fixably coupled. It will be appreciated that numerous alternative shapes, manufacturing schemes, and coupling schemes may be utilized in accordance with embodiments of the present invention.

Figure 6:
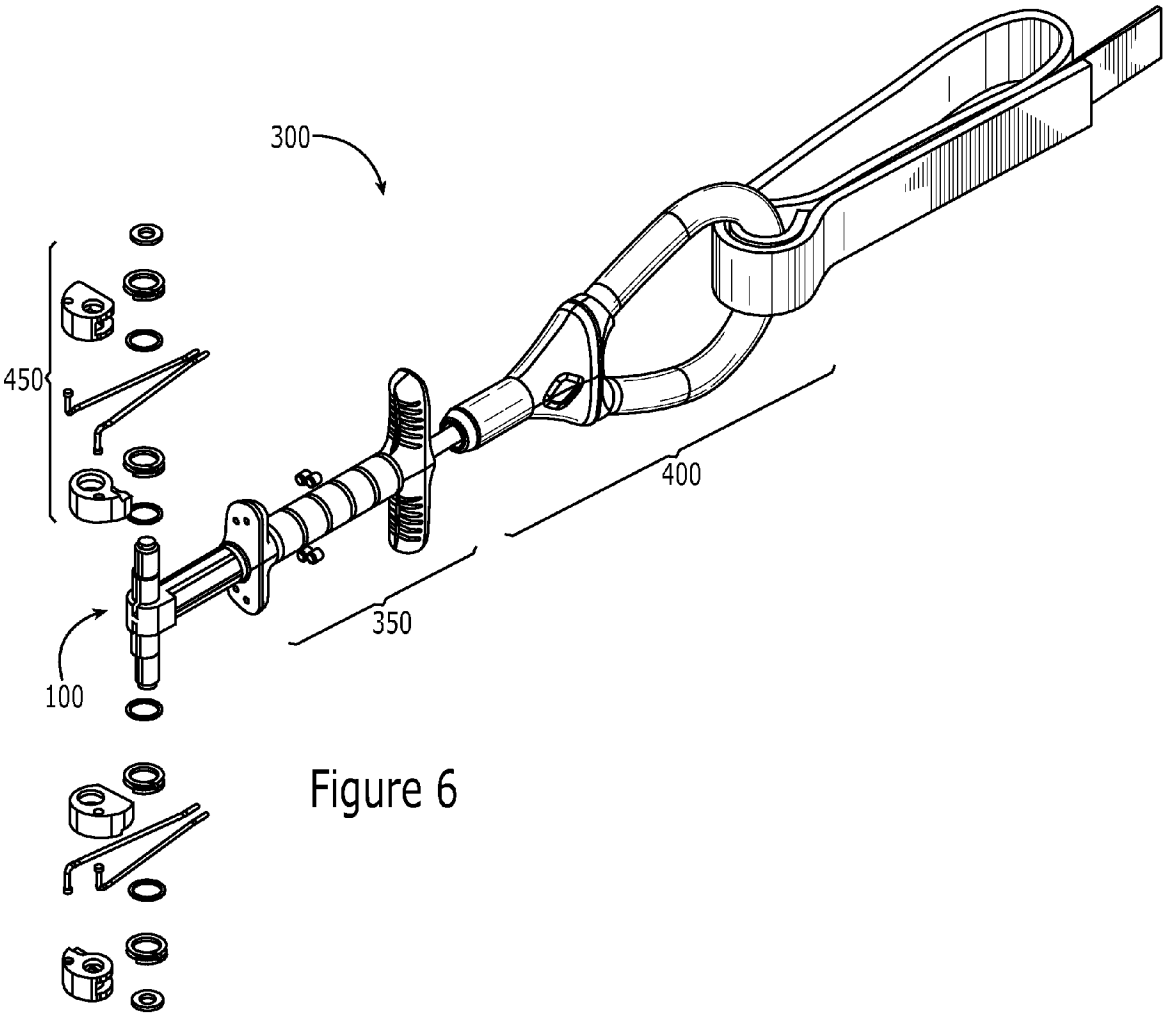
FIG. 6 illustrates an exploded perspective view of a small active camming device in accordance with embodiments of the present invention.
Figure 7:
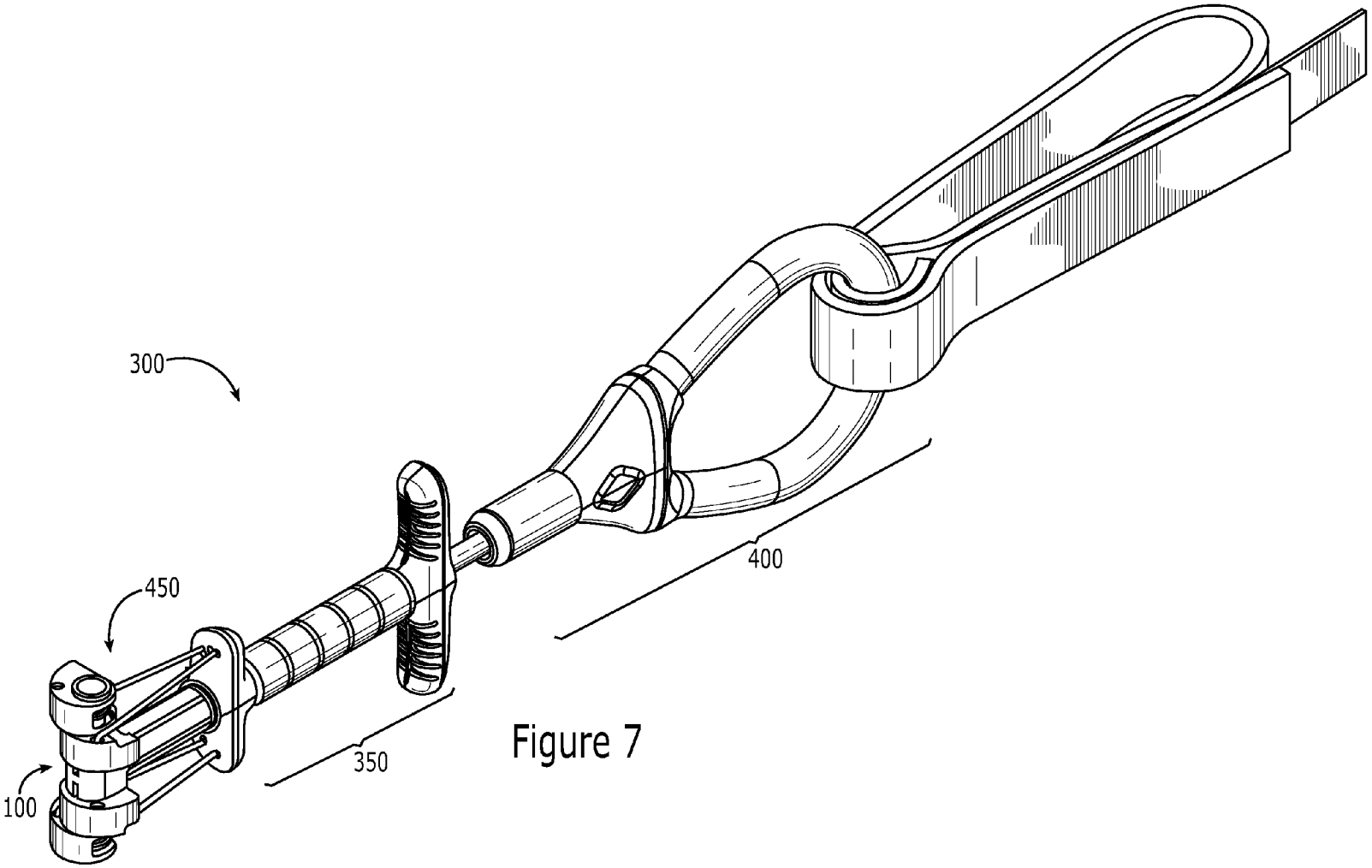
FIG. 7 illustrates an perspective view of an extended small active camming device in accordance with embodiments of the present invention.
Figure 8:
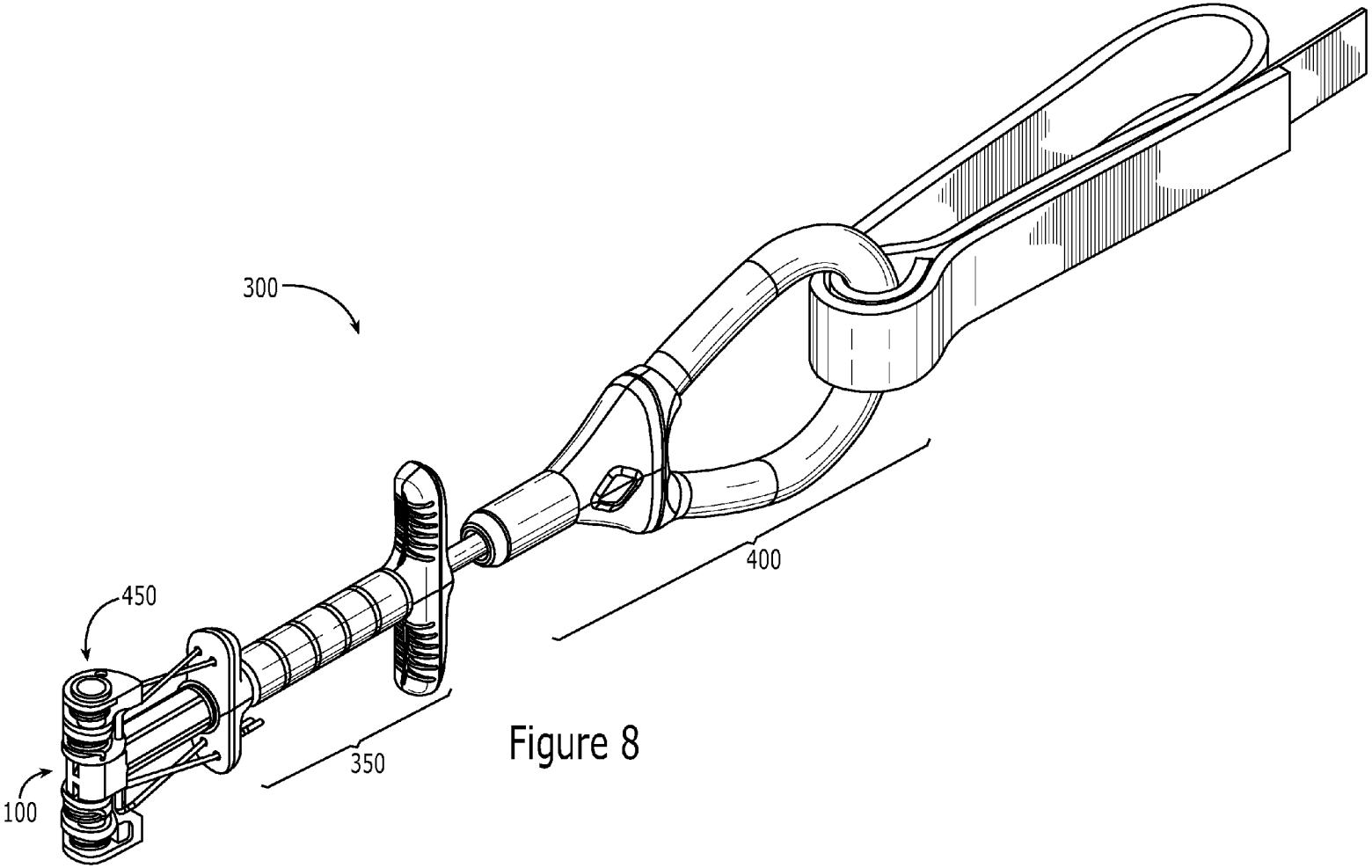
FIG. 8 illustrates an exploded view of a retracted small active camming device in accordance with embodiments of the present invention.

Reference is next made to FIGS. 6-8, which illustrate a small active camming device, designated generally at 300. The illustrated active camming device 300 system includes the cam head 100 illustrated in FIGS. 1-4. Element 450 designates portions of the retraction system including trigger wires, biasing springs, axle couplers, and the cam lobes. Element 350 designates a medial region including portions of the retraction system (i.e. trigger, stem cover, yoke) and the stem of the connection system. Element 400 designates a thumb rest and loop region of the connection system. The cam lobes are rotatably coupled around the axle to enable rotation between an extended state (FIG. 7) and a retracted state (FIG. 8). The cam lobes are spring biased toward the extended state. The configuration of the components enables the selective engagement of the retracted state via the retraction of a trigger region versus the thumb rest. The stem region includes both coupling the cam head 100 to the remainder of the system and coupling the retraction system between the trigger and the cam head 100. The exploded view of FIG. 6 illustrates the components of the illustrated active camming device system embodiment.

Figure 1:
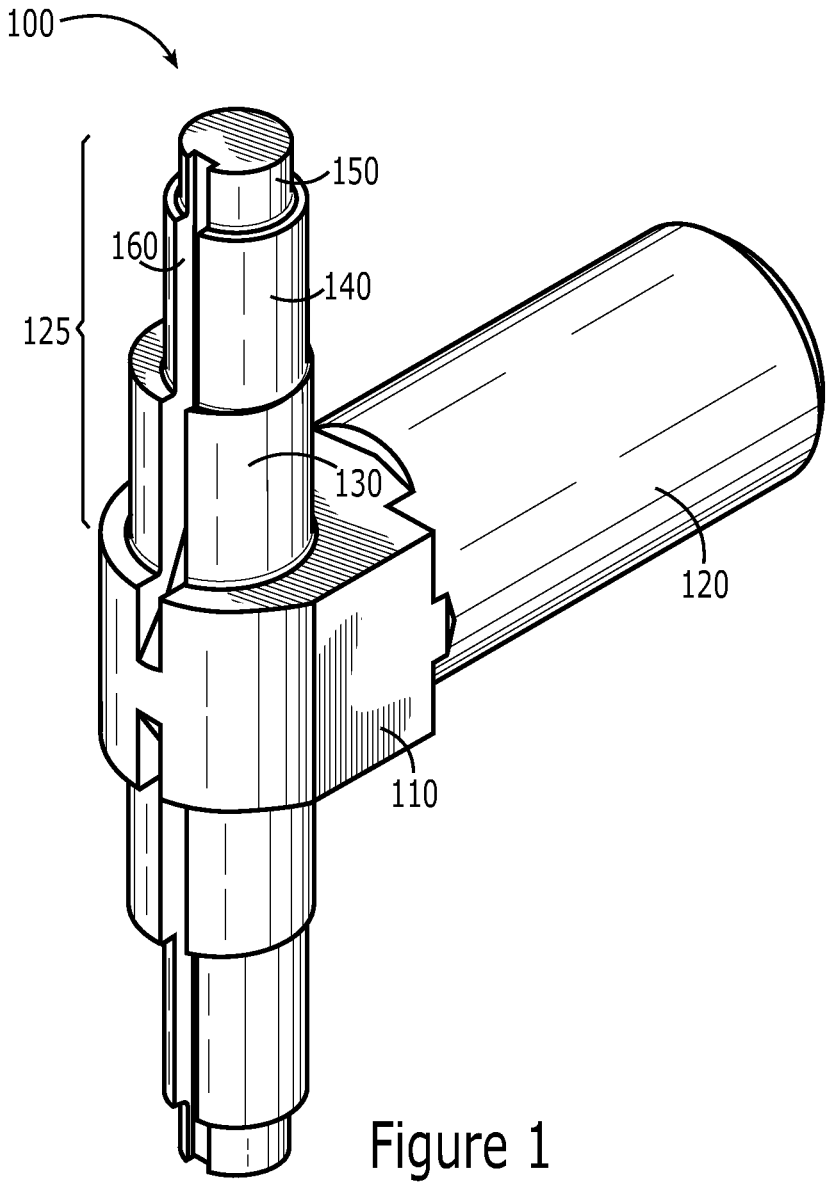
FIG. 1 illustrates a perspective view of one embodiment of a cam head portion of an active camming device in accordance with embodiments of the present invention.

It should be noted that various alternative system designs may be practiced in accordance with the present invention, including one or more portions or concepts of the embodiment illustrated in FIG. 1 as described above. Various other embodiments have been contemplated, including combinations in whole or in part of the embodiments described above. Various alternative active camming devices and partial camming devices may incorporate embodiments of the present invention.

What is claimed is:

1. An active camming device system comprising:
a head member comprising a terminal and an axle;
a plurality of cam lobes coupled to the axle;
a retraction system coupled to the plurality of cam lobes;
a connection system coupled to the terminal, wherein the connection system includes a stem coupled to the terminal, a thumb rest, and a loop; and
wherein the axle includes a plurality of radial regions extending from opposite sides of the terminal, and wherein the plurality of radial regions are each offset with respect to at least one of the terminal and at least one of the other radial regions along at least one axis.

2. The system claim 1, wherein each of the plurality of cam lobes are rotatably coupled to one of the plurality of radial regions.

3. The system of claim 1, wherein the offset of the plurality of radial regions with respect to one another along the at least one axis includes offsetting each radial region distal of the terminal with respect to the adjacent radial region proximal of the terminal.

4. The system of claim 1, wherein the plurality of radial regions includes at least four radial regions with two radial regions disposed on opposite sides of the terminal.

5. The system of claim 1, wherein the plurality of radial regions are cylindrically shaped and intercoupled in an offset lengthwise configuration forming the axle.

6. The system of claim 1, wherein the offset of the plurality of radial regions with respect to one another along the at least one axis is configured to geometrically reduce interference between the cam lobes in a refracted state.

7. The system of claim 1, wherein the radial region directly proximal to the terminal has the largest diameter with respect to the distal radial regions.

8. The system of claim 1, wherein an external surface of the distal most radial region with respect to the terminal is shaped and oriented to align with an external surface of the proximal most radial region with respect to the terminal.

9. The system of claim 8, wherein the plurality of radial regions include a channel along the aligned external surfaces of the plurality of radial regions.

10. The system of claim 1, wherein the stem is a substantially elongated member extending between the terminal and the thumb rest.

11. The system of claim 1, wherein the terminal and axle are substantially T shaped.

12. The system of claim 1, wherein the offset of the plurality of radial regions with respect to one another along at least one axis is configured to geometrically reduce interference between the cam lobes in a refracted state.

13. The system of claim 1, wherein an external surface of the distal most radial region with respect to the terminal is shaped and oriented to align with an external surface of the proximal most radial region with respect to the terminal.

14. The system of claim 13, wherein the plurality of radial regions include a channel along the aligned external surfaces of the plurality of radial regions.

15. An active camming device system configured for camming in a region below one inch comprising:
a head member comprising a terminal and an axle;
a plurality of cam lobes coupled to the axle;
a retraction system coupled to the plurality of cam lobes;
a connection system coupled to the terminal, wherein the connection system includes a stem coupled to the terminal, a thumb rest, and a loop; and
wherein the axle includes a plurality of radial regions extending from opposite sides of the terminal, and wherein each of the plurality of cam lobes are rotatably coupled to one of the plurality of radial regions, and wherein the plurality of radial regions are each offset with respect to at least one of the terminal and at least one of the other radial regions along at least one axis.

16. An active camming device head member system comprising:
a terminal, wherein the terminal is configured to fixably couple with an active camming device stem; and
an axle including a plurality of radial regions extending from opposite sides of the terminal, and wherein the plurality of radial regions are each offset with respect to at least one of the terminal and at least one of the other radial regions along at least one axis.

17. The system of claim 16, wherein the active camming device head member is substantially T-shaped.

18. The system of claim 16, wherein the offset of the plurality of radial regions with respect to one another along at least one axis includes offsetting each radial region distal of the terminal with respect to the adjacent radial region proximal of the terminal.

19. The system of claim 16, wherein the plurality of radial regions includes at least four radial regions with two radial regions disposed on opposite sides of the terminal.

20. The system of claim 16, wherein the plurality of radial regions are cylindrically shaped and intercoupled in an offset lengthwise configuration forming the axle.

* * * * *